US005490311A

United States Patent [19]

Rosier

[11] Patent Number: 5,490,311

[45] Date of Patent: Feb. 13, 1996

[54] ERGONOMIC INSTALLATION TOOL WITH SELECTABLE VACUUM PINTAIL COLLECTOR

[75] Inventor: Hendrik E. Rosier, Kingston, N.Y.

[73] Assignee: Huck International, Inc., Kingston, N.Y.

[21] Appl. No.: 302,495

[22] Filed: Sep. 8, 1994

[51] Int. Cl.[6] ..... B21J 15/22

[52] U.S. Cl. ..... 29/243.523; 29/243.525

[58] Field of Search ..... 29/243.523, 243.524, 29/243.525

[56] References Cited

U.S. PATENT DOCUMENTS

| | | | |
|---|---|---|---|
| 3,375,883 | 4/1968 | Schadlich | 173/170 |
| 4,005,598 | 2/1977 | Ehmann et al. | 72/391 |
| 4,027,520 | 6/1977 | Klein | 72/391 |
| 4,275,583 | 6/1981 | Gilbert et al. | 29/243.525 |
| 4,281,531 | 8/1981 | Ehmann et al. | 29/243.525 |
| 4,351,179 | 9/1982 | Fiebiger | 72/391 |
| 4,515,005 | 5/1985 | Klein | 72/391 |
| 4,517,820 | 5/1985 | Oefinger et al. | 29/243.525 |
| 4,598,571 | 7/1986 | Oefinger | 29/243.525 |
| 4,612,793 | 9/1986 | Klein | 72/311 |
| 4,887,450 | 12/1989 | Gast et al. | 29/243.523 |
| 4,888,974 | 12/1989 | Mandell | 29/243.523 |
| 4,896,522 | 1/1990 | Rosier | 72/391 |
| 4,964,292 | 10/1990 | Kaelin et al. | 72/453.17 |
| 4,989,442 | 2/1991 | Rosier | 72/391.2 |
| 5,119,554 | 6/1992 | Wilcox | 29/252 |
| 5,142,774 | 9/1992 | Jeffrey | 29/810 |
| 5,146,773 | 9/1992 | Rosier | 72/391.4 |

OTHER PUBLICATIONS

Gesipa Blindniettechnik GmbH, *GESIPA—Blind Riveting Tool PH 2,* Service Instruction and Spare Part List, (Jul. 1987).

Gesipa Blindniettechnik GmbH, *Vacuum Absorption System for Blind Riveting Power Tools PH 1 and PH 2,* Operating and Service Instructions with Spare Parts List, (no date).

Lobtex Co., Ltd., *New Lobster Vacuum Unit,* Product Brochure and Installation Instructions, (no date).

*Primary Examiner*—David Jones

*Attorney, Agent, or Firm*—Madson & Metcalf

[57] ABSTRACT

A pintail fastener installation tool includes a nose piston cylinder which surrounds a nose piston having a longitudinal bore which is aligned with a jaw opening of a nose assembly. The nose piston also has a venturi bore which meets the longitudinal bore at an angle. When connected to a source of pressurized air and enabled, the venturi bore creates a venturi effect which suctions detached pintails out of the nose assembly and piston into a container. The venturi bore may be disabled by a slide valve which separates the venturi bore from the air feed. The slide valve includes a ring which is positioned around the exterior of the nose piston cylinder. The slide valve is linearly slidable between an open position, which allows pressurized air to flow from the air feed to the venturi bore, and a closed position, which prevents air flow from the air feed to the venturi bore. A pintail container secured to the nose piston cylinder includes a slotted inner bottle and a slotted outer bottle with ribs. The bottles are rotatable relative to one another. The tool is connectable to a pressurized air hose by way of a rotatable air inlet swivel. The tool is ergonomically designed to reduce stresses on the user and facilitate proper positioning of the tool.

29 Claims, 5 Drawing Sheets

ERGONOMIC INSTALLATION TOOL WITH SELECTABLE VACUUM PINTAIL COLLECTOR

FIELD OF THE INVENTION

The present invention relates to a tool for installing swage fasteners, rivets, and similar fasteners by applying a force which deforms the fastener's head and detaches the fastener's pintail, and more particularly, to an ergonomic installation tool having a pintail collector which utilizes a vacuum force that is easily enabled or disabled by the tool's user.

TECHNICAL BACKGROUND OF THE INVENTION

Swage fasteners, rivets, and similar fasteners are commonly used to secure together a wide variety of workpieces in industries ranging from aircraft and aerospace manufacturing to building construction. Such fasteners, which include a deformable head disposed around a shaft and a pintail which is detachably secured to the shaft, are collectively referred to herein as "pintail fasteners." As used herein, "head" is not restricted to a structure fixed to one end of a fastener. In some fasteners the head is secured about one end of the shaft. But in others the head includes a deformable collar which can be moved along the shaft before the fastener is installed by swaging the collar into locking grooves on the shaft.

Pintail fasteners are favored because they provide a tight, durable connection without threads, and because they may be installed rapidly. Pintail fasteners are often used to fasten materials such as sheet metal which are not amenable to other fasteners such as adhesives, nails, or screws.

Although pintail fasteners have numerous advantages, conventional installation tools used to install pintail fasteners suffer from several drawbacks. To understand the shortcomings of conventional installation tools, it is helpful to understand how a pintail fastener is installed. Initially, the pintail of the fastener is inserted between the jaws of a nose assembly which is attached to the installation tool. The nose assembly is typically detachable from the tool, so that one tool may be used with a variety of nose assemblies. The nose assembly is selected according to the particular type of fastener being installed.

At least a portion of the fastener's shaft is then inserted through aligned holes in the workpieces which are being fastened. The fastener is selected so that at least part of the fastener's head is larger than a hole in one of the workpieces. The head abuts the workpiece around the hole.

Next, an installation force is applied to the fastener by the installation tool and the nose assembly. The installation force is generated by the tool and is transferred to the nose assembly by a nose piston in the tool. The force is directed generally along the shaft and away from the workpieces. The nose assembly's jaws tighten around the pintail and urge the pintail, and hence the shaft, away from the workpieces. The pintail typically contains annular grooves to enhance the gripping ability of the jaws. The pintail grooves are normally separate rather than being formed as threads.

The installation force presses the fastener's head against the workpiece. The fastener is configured such that as application of the installation force continues, the head deforms in shape and the shaft moves further through the holes. Deformation typically increases the cross-sectional diameter of the head transverse to the shaft, and may also serve to secure the head so that it is immobile with respect to the shaft. Installation deforms the head in such a way that the workpieces are trapped between portions of the fastener which are larger than the holes.

The fastener is typically formed such that a portion of the shaft immediately adjacent the pintail is narrowed or weakened with respect to the rest of the shaft. Upon sufficient application of the installation force, the pintail therefore detaches suddenly from the shafts. The detached pintail may be discarded, or it may be collected for later use in forming new pintail fasteners.

Unfortunately, some conventional installation tools do not deal effectively with detached pintails. Depending on the circumstances, detached pintails may remain in place, or they may shoot away from the workpieces. The pressures required to properly deform fastener heads during installation commonly exceed three thousand p.s.i., so it is not uncommon for a detached pintail to fly rapidly away from the fastener shaft. Many conventional tools simply deflect the flying pintails toward the floor to prevent injury to the tool's user or other damage.

Such conventional tools thus permit the detached pintails to lie haphazardly about the work area. Because the detached pintails must eventually be collected in any case when the work area is cleaned, some known tools include a pintail container which holds ejected pintails. One such container consists of an inner bottle and an outer bottle which are rotatable relative to one another. Each of the bottles has a slot in its side. The bottles are configured such that a pintail may be removed from within the container by rotating the bottles until the slots align and then aligning the pintail so that it drops through the slots. Unfortunately, the smooth surface of the bottles often make them difficult to rotate, and hence to empty, under real-world working conditions.

After being detached, a pintail may also remain in place within the nose assembly. Subsequent insertion of the pintail of an intact second fastener in preparation for installation of the second fastener may jam the tool. Many conventional tools fail to force pintails out of the nose assembly and out of the nose piston after detachment to make way for the next fastener. Thus, the tool's user is forced to shake the tool until the pintail falls out, or to otherwise spend time and effort to displace the first pintail.

Accordingly, some conventional tools use pressurized air to create a suction effect which draws the detached pintail out of the nose assembly and out of the nose piston. The suction may also be used to hold the next fastener in position between the jaws as the tool is moved to place a portion of the next fastener in the workpiece holes. The suction is created by an air flow which is generated either directly or indirectly by pressurized air that is supplied to the tool through a conventional air hose.

Unfortunately, known tools do not provide an easily operated, flexible means for the user to selectively enable or disable the suction effect. It is desirable to disable suction when the tool is not in active use but is still connected to the air hose in order to reduce the energy spent pressurizing the air hose. It is also desirable to disable the suction, thereby saving energy, if the particular pintails being used do not tend to stick in the particular nose assembly being used but rather slide out easily without suction or substantial user effort.

Some known tools contain only automatic means for disabling the suction effect. These automatic means typically depend on the position of the nose piston relative to the rest of the tool and thus fail to provide users with flexible control over the suction. Other tools contain valves which permit users to enable or disable suction by repeated rotations of a screw, a T-shaped valve handle, or the like. Many such valves are inconvenient because they require a screwdriver or wrench for operation. Moreover, even if such valves are operated solely by hand, they require users to spend too much time and effort performing the necessary repeated rotational movements.

An additional drawback of many conventional installation tools is the difficulty a user faces in properly positioning the tool. A variety of factors typically contribute to make tool positioning difficult. Tool weight is certainly a factor, as the tools commonly weigh from about eight to about 15 pounds. However, other factors are also important. For instance, the tools are often attached to a pressurized air hose by a rigid connector which is fixed in position relative to the rest of the tool. Positioning such a tool requires lifting an extra section of the air hose whenever the tool is not oriented with the air hose connector pointing directly downward.

In addition, the tool handle is typically positioned substantially at a right angle to the nose piston. Users typically hold both the nose piston and their forearms substantially perpendicular to the workpieces. In this position, a conventional tool with a perpendicularly-mounted handle imposes increased stresses on the user's wrist relative to a wrist which is positioned at a more natural angle.

Another drawback of many conventional tools is that they are configured such that the nose assembly and the tool's handle both rest near or on the floor when the tool is set down. The user must "scoop" the tool up by sliding the fingers of one hand along the floor, or even against the floor, until they are under the handle. Repeated scooping movements may result in scraped hands and fingers. In addition, the nose assembly may collect dirt, metal shavings, or other contaminants as a result of being repeatedly placed against the floor of the work area. Contaminated nose assemblies often require a time-consuming cleaning operation before they will operate effectively.

Thus, it would be an advancement in the art to provide a pintail fastener installation tool which provides an easily-operated and flexible suction for removing pintails from the nose assembly after they are detached from fasteners.

It would also be an advancement in the art to provide such a tool which collects the detached pintails in an easily-emptied container rather than allowing them to hit the user or the work area floor.

It would be a further advancement to provide such a tool which facilitates proper positioning of the tool by reducing the stresses imposed on a user.

It would be an additional advancement to provide such a tool which reduces the risk of nose assembly contamination by holding the nose assembly above the work area floor when the tool is set down.

Such an installation tool is disclosed and claimed herein.

BRIEF SUMMARY OF THE INVENTION

The present invention provides a tool for use in installing pintail fasteners in workpieces. A presently preferred embodiment of the tool is connectable to a nose assembly that is configured to apply an installation force to a fastener. The nose assembly includes a set of jaws that grip the pintail of the fastener and apply an installation force to the fastener. The installation force is generated by the tool.

The tool includes a nose piston cylinder which surrounds a nose piston. The nose piston has a longitudinal bore which is aligned with the jaw opening of the nose assembly. The nose piston's longitudinal bore connects a nose orifice in the piston's nose end with a tail orifice in the piston's tail end. The end of the nose piston is connectable to the nose assembly.

The nose piston also has a venturi bore which meets the longitudinal bore at a venturi orifice. The venturi bore points generally toward the tail end of the nose piston. That is, the venturi bore is oriented at an acute angle with respect to the portion of the longitudinal bore that is located between the nose orifice and the venturi orifice. The venturi bore is connectable at an air feed to a source of pressurized air such as a conventional air hose that contains air pressurized by a conventional air compressor.

The tool also includes a slide valve which is disposed between the venturi bore and the air feed. The slide valve includes a ring which is positioned around the exterior of the nose piston cylinder. The ring has a recess on its inner surface adjacent the nose piston cylinder. The recess is in substantial fluid communication with the air feed.

The slide valve is linearly slidable between an open position, which allows pressurized air to flow from the air feed to the venturi bore, and a closed position, which prevents air flow from the air feed to the venturi bore. To achieve this control, the recess is positioned relative to the venturi bore such that the recess is in substantial fluid communication with the venturi bore when the ring is in the open position, and the recess is not in substantial fluid communication with the venturi bore when the ring is in the closed position. The outer surface of the ring has knurls, ridges, or other projections to enable the user to easily grasp the ring.

A pintail container is secured to the nose piston cylinder about the tail orifice of the longitudinal bore to receive and contain detached pintails. The pintail container includes an inner bottle and an outer bottle which are rotatable relative to one another. Each of the bottles has a slot in its side, so that pintails may be removed from the container by rotating the bottles until the slots align and then dropping the pintails through the slots. To facilitate rotation, the outer bottle has longitudinal protruding ribs spaced about 30 degrees apart around its side. In an alternative embodiment, a pintail deflector is secured to the nose piston cylinder about the tail orifice of the longitudinal bore. The deflector deflects detached pintails toward the floor.

In addition, the tool includes an assembly for pressurizing the nose piston cylinder. The pressurizing assembly includes an air cylinder in which a piston head is disposed. The piston head divides the air cylinder into a variably-sized drive chamber and a corresponding variably-sized release chamber. The size of one chamber grows, and the size of the other chamber shrinks, as the piston head slides within the air cylinder.

A hydraulic cylinder containing an incompressible hydraulic fluid is positioned adjacent the air cylinder but is separated from the air cylinder by a gland assembly. A piston rod which is secured to the piston head and which is immobile with respect to the piston head slides within the hydraulic cylinder as the piston head slides within the air cylinder. The hydraulic fluid in the hydraulic cylinder is in fluid communication with additional hydraulic fluid located inside the nose piston cylinder. A dampening valve allows gradual movement of hydraulic fluid from the hydraulic cylinder to the nose piston cylinder while inhibiting rapid fluid movement in the opposite direction.

The exterior of the hydraulic cylinder serves as a hand grip for the user. The hydraulic cylinder is oriented at an angle in the range from about 10 degrees to about 20 degrees away from a right angle with respect to the nose piston cylinder. Thus, the nose piston cylinder and the user's forearm can each be held perpendicular to the workpieces without forcing the user's wrist into an uncomfortable position.

The air cylinder is in fluid communication with a throttle which is connectable to a conventional pressurized air hose. The throttle includes a trigger for selective pressurization of the drive chamber of the air cylinder. The throttle is connected to the air hose by an air inlet swivel which will rotate through 360 degrees or more while transporting pressurized air toward the drive chamber. The hose tends to hang straight down as the tool is rotated, thereby reducing the amount of hose that must be lifted to position the tool in comparison with conventional tools that employ a rigid connector.

The air cylinder is also in fluid communication with an exhaust path which leads from the drive chamber to the ambient environment outside the tool. A muffler disposed along the exhaust path muffles the flow of air exhausted from the drive chamber, making the tool quieter during use than unmuffled conventional tools.

The air cylinder forms a stable base for the tool. The base has sufficient area, and the tool's mass is positioned relative to the base, such that the base is capable of stable engagement with a resting surface such as a table or floor. The tool may be placed in a stable position on the resting surface with the nose piston cylinder spaced substantially above the resting surface. The tool handle is easily grasped without sliding one's fingers along the floor. Moreover, the risk of contaminating the nose assembly is greatly reduced because the nose assembly is held above the work area floor.

In operation, the pintail of a fastener is placed between the jaws of the nose assembly and a portion of the fastener is placed within aligned holes in two or more workpieces. The trigger of the throttle is activated, allowing pressurized air to flow into the drive chamber. Pressurization of the drive chamber increases the size of the chamber by driving the piston head. The piston head in turn drives the piston rod toward the nose piston cylinder. The piston rod pressurizes the hydraulic fluid within the hydraulic cylinder, and hence pressurizes the hydraulic fluid within the nose piston cylinder.

The increased pressure in the nose piston cylinder urges the nose piston away from its initial "ready" position and thus away from the workpieces. The nose piston in turn creates an installation force which is transferred to the attached nose assembly. The installation force tightens the nose assembly jaws about the pintail and pulls the pintail away from the workpieces. In response, the fastener's head deforms, and the fastener's pintail eventually detaches from the rest of the fastener. At this point the nose piston is in its "detaching" position, which may vary slightly from one fastener to the next.

Upon detachment, the nose assembly is typically removed from its position against the workpieces. Thus, the piston may attempt to move rapidly toward the nose end of the nose piston cylinder. However, the piston's movement is dampened by the hydraulic fluid because sudden flow of the hydraulic fluid back into the hydraulic cylinder is restricted by the dampening valve. The hydraulic fluid flowing back into the hydraulic cylinder urges the piston rod away from the nose piston cylinder, and hence moves the piston head in a direction that decreases the size of the drive chamber. The throttle is configured to open the exhaust path when the nose piston reaches the detachment position, so the air from the drive chamber flows out toward the ambient environment. The flow of exhaust air is muffled by the muffler to reduce noise levels.

If the slide valve is in the open position, the detached pintail will not remain in the longitudinal piston bore, but will rather be forced by a venturi effect into contact with the deflector or the pintail container. When the slide valve is open and the nose piston has returned to its initial position nearest the nose assembly, air flows through the venturi bore under pressure. Air flowing through the venturi bore into the longitudinal bore under sufficient pressure creates a venturi effect which is capable of drawing the detached pintail toward and through the tail orifice. The air flows from the tail orifice past the pintail deflector or through exhaust orifices in the ends of the pintail container bottles. The venturi effect, which is also termed a "vacuum effect" or a "suction effect," thus makes it unnecessary for users to shake the tool to move a detached pintail aside to make room for another fastener.

The venturi bore is positioned relative to the nose piston cylinder such that the nose piston cylinder blocks air flow to the venturi bore as the nose piston approaches the detaching position during installation, even if the slide valve is open. Thus, the entire pressurized air flow from the compressor is applied to the drive chamber during installation. The venturi effect is created only when the nose piston is near its ready position and the slide valve is open.

Importantly, control of the venturi effect is not limited to this automatic control based on the nose piston's position. In addition, users may easily slide the ring to close the slide valve, thereby conserving compressed air when the tool is not in active use or when the tool is in use but no venturi is needed to remove pintails from the nose piston.

These and other features and advantages of the present invention will become more fully apparent through the following description and appended claims taken in conjunction with the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide a selected embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
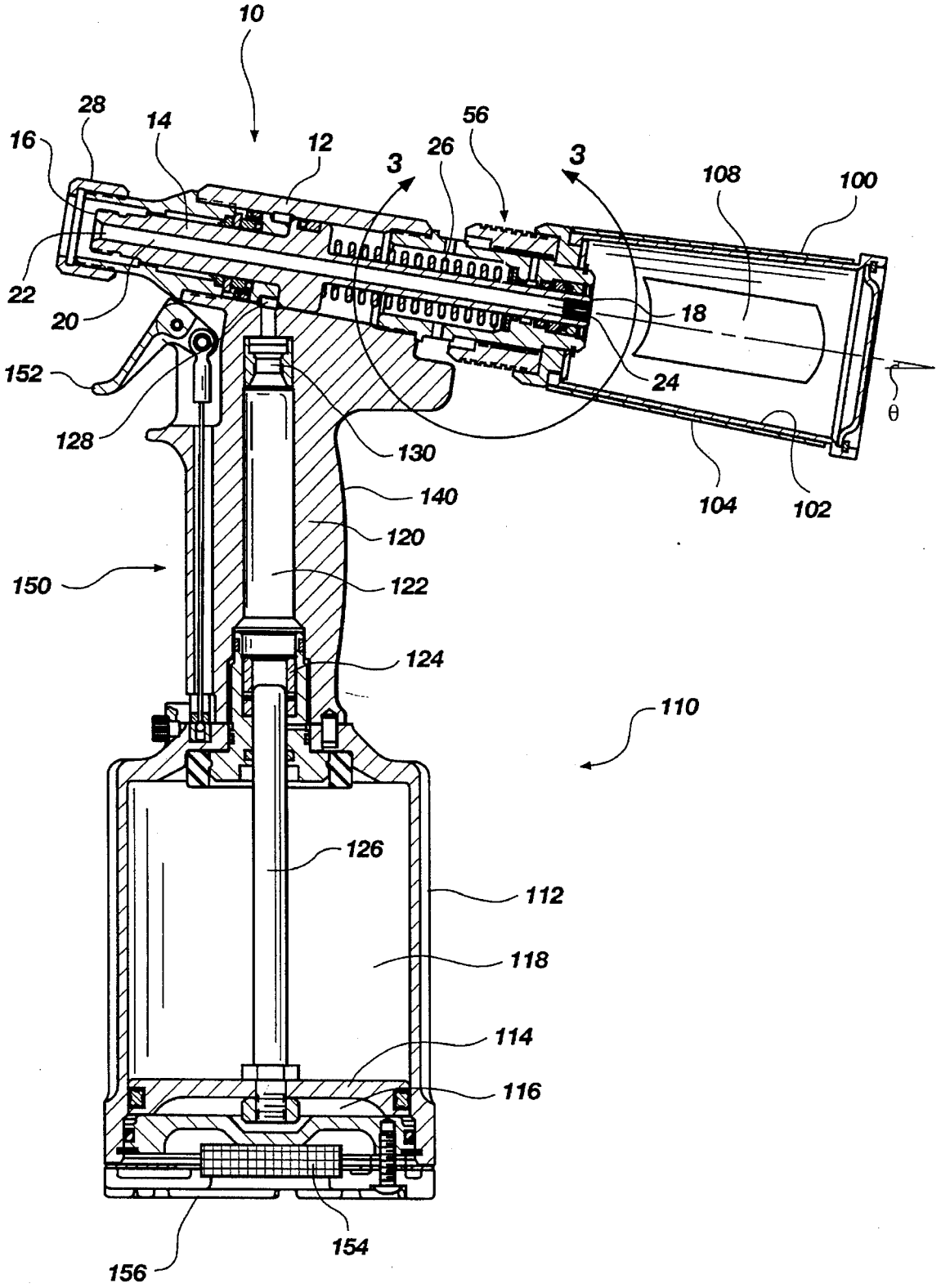
FIG. 1 is a cross-sectional view taken along line 1—1 of FIG. 4 illustrating a preferred embodiment of the installation tool of the present invention.

Reference is now made to the figures wherein like parts are referred to by like numerals. With reference to FIG. 1, the present invention relates to a tool, which is generally indicated at 10, for use in installing pintail fasteners (not shown) in workpieces (not shown). Suitable pintail fasteners include fasteners such as those described in U.S. Pat. Nos. 5,049,016, 5,090,852, 5,125,778, and 5,171,115, issued to Nordyke, Dixon, Sadri, and McWilliams et al., respectively, and assigned to Huck International, Inc., as well as similar fasteners which have a deformable head disposed around a shaft and a pintail which is detachably secured to the shaft. Suitable workpieces may be formed of metal, composite materials, plastic, or any other rigid material.

The tool 10 includes a nose piston cylinder 12 which surrounds a nose piston 14. The nose piston 14 has a nose end 16 and a tail end 18. The nose piston 14 also has a longitudinal bore 20 which connects a nose orifice 22 with a tail orifice 24. A spring 26 urges the nose piston 14 toward the nose end of the nose piston cylinder 12. A retaining nut 28 is threadable onto the nose end of the nose piston cylinder 12 for use in connecting the tool 10 to a nose assembly, such as the nose assembly indicated generally at 30 in FIG. 2. A nose assembly must be connected to the tool 10 to permit use of the tool 10 in installing pintail fasteners.

Figure 2:
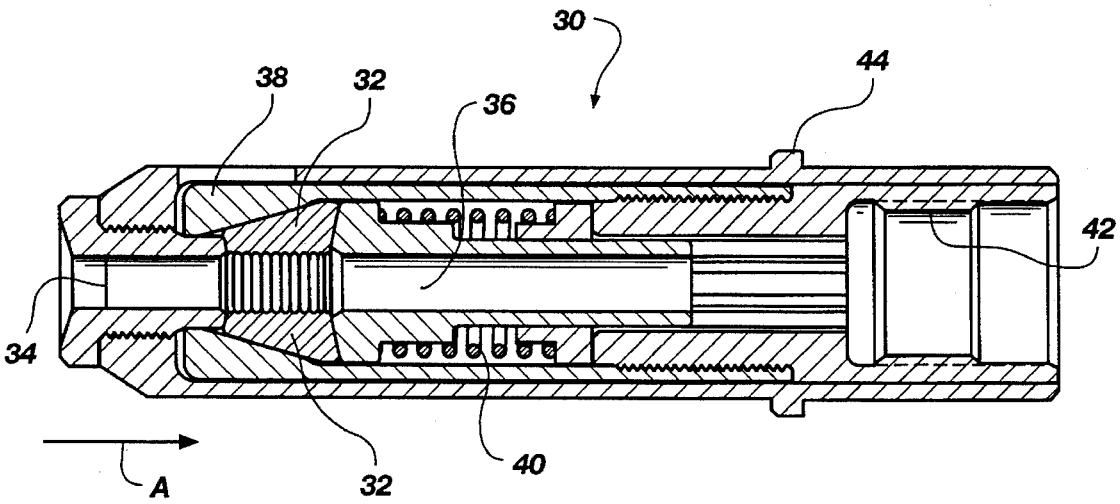
FIG. 2 is a cross-sectional view corresponding to the view in FIG. 1, illustrating a nose assembly which is connectable to the tool of the present invention.

With reference to FIGS. 1 and 2, the nose assembly contains a set of jaws 32 disposed about an opening 34 of a passage 36. The jaws 32 are configured to grip annular grooves or locking rings of the type commonly found on the pintails of pintail fasteners (not shown). The nose assembly 30 also contains a collet 38, a spring 40, and other elements familiar to those of skill in the art.

An engagement portion 42 of the nose assembly 30 is configured for releasable engagement with the nose end 16 of the nose piston 14. The retaining nut 28 is capable of being threaded onto the nose piston cylinder 12 over a flange 44 to secure the connection between the nose assembly 30 and the tool 10. When the nose assembly 30 is thus connected to the tool 10, the passage 36 is aligned with the longitudinal bore 20 of the nose piston 14.

Figure 3:
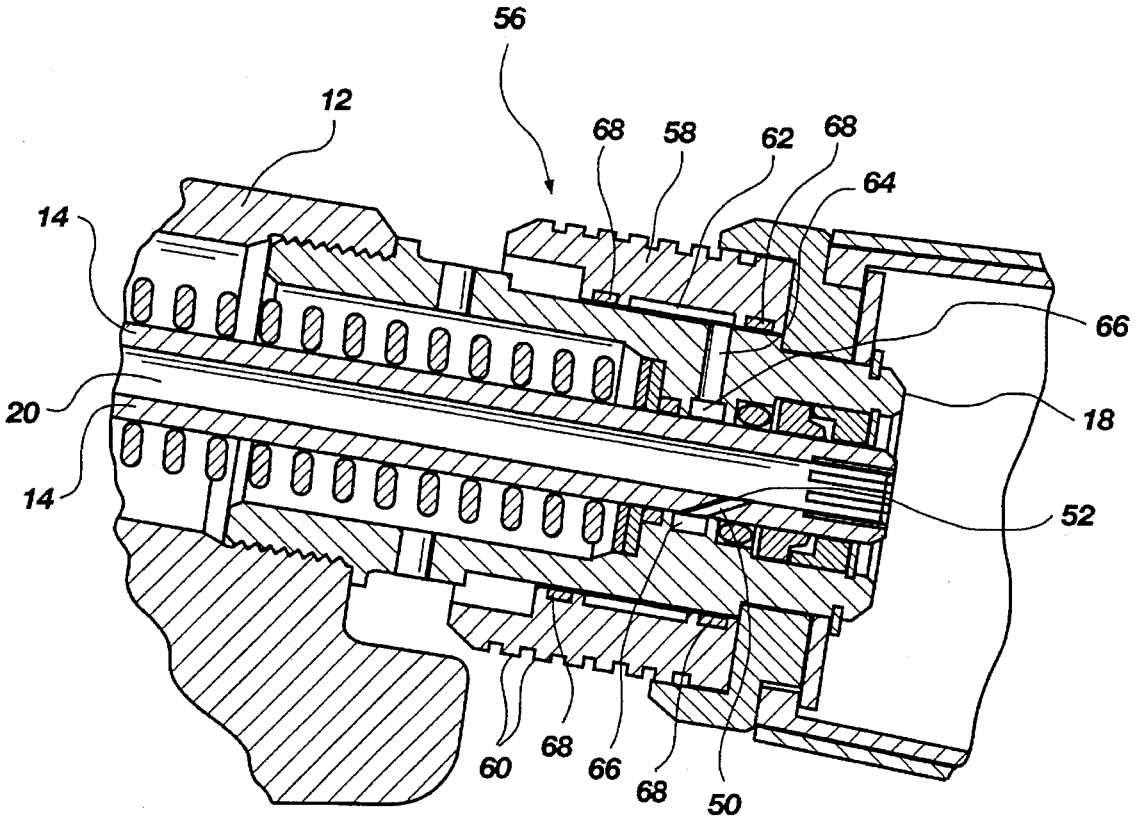
FIG. 3 is an enlarged view of a portion of the tool shown in FIG. 1, further illustrating a slide valve.

As shown best in FIG. 3, the nose piston 14 also has a venturi bore 50 which meets the longitudinal bore 20 at a venturi orifice 52. The venturi bore 50 points generally toward the tail end 18 of the nose piston 14. That is, the venturi bore 50 is oriented at an acute angle with respect to the portion of the longitudinal bore 20 that is located between the nose orifice 22 (FIG. 1) and the venturi orifice 52. Although a single venturi bore 50 is illustrated, alternative embodiments include a plurality of venturi bores spaced apart about the nose piston 14.

Figure 4:
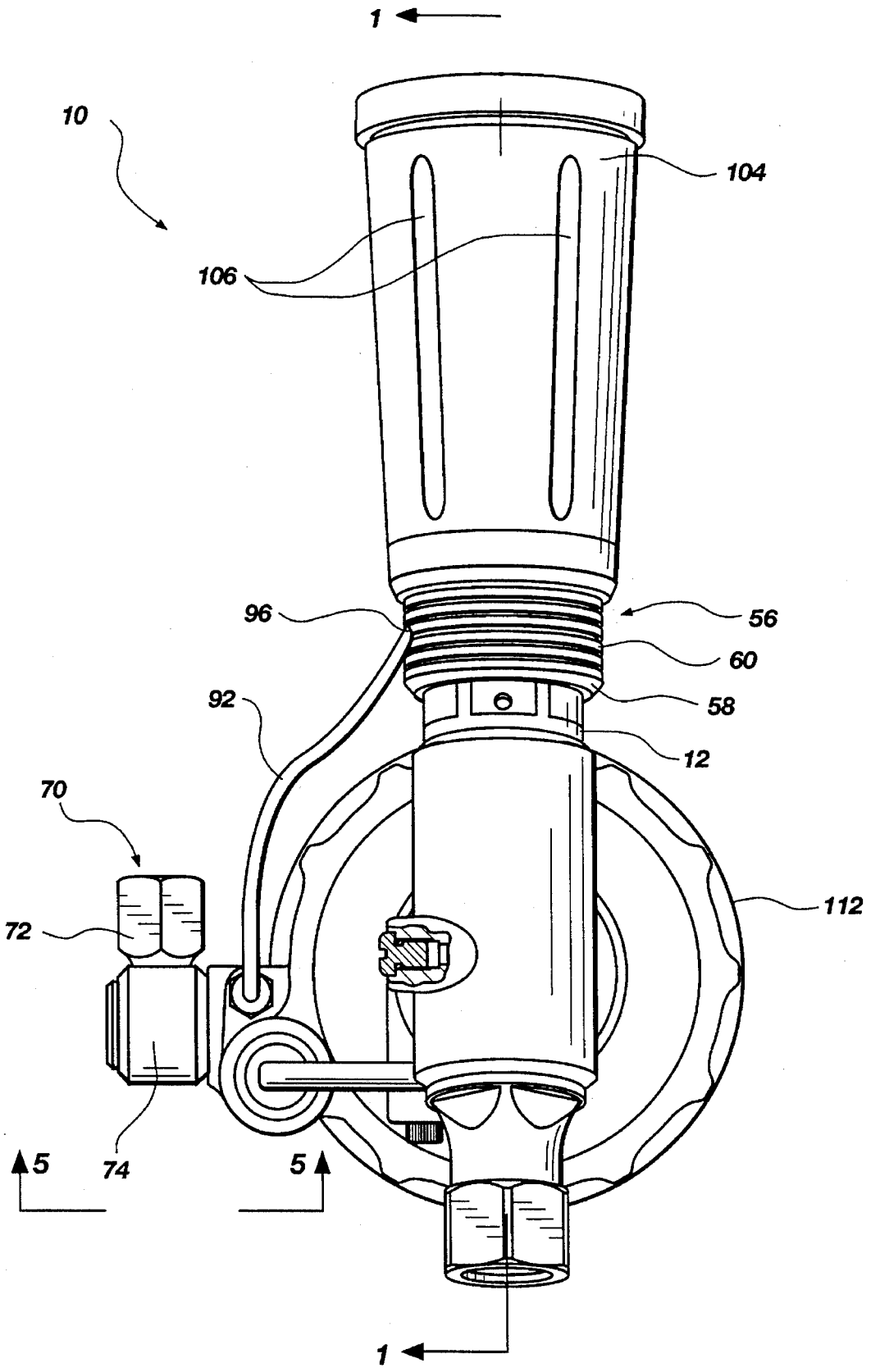
FIG. 4 is a top view of the installation tool, further illustrating the slide valve, and also illustrating an air inlet swivel.

As illustrated in FIGS. 3 and 4, the tool 10 also includes a slide valve, which is indicated generally at 56. The slide valve 56 preferably includes a ring 58 which is positioned around the exterior of the nose piston cylinder 12. The outer surface of the ring 58 is equipped with ridges 60 to enable the user to easily grasp the ring 58 and slide it along the nose piston cylinder 12.

In alternative embodiments, a plate shaped like a portion of the ring is used in place of the ring. The inner portion of the plate is shaped to conform to the outer portion of the nose piston cylinder along which the plate slides. The outer surface of the plate is equipped with ridges, knurls, or other projections to aid users in grasping and sliding the plate by hand.

The ring 58 is slidable between the open position illustrated in FIG. 3, and one or more closed positions. In the open position, a recess 62 on the inner surface of the ring 58 adjacent the nose piston cylinder 12 is in substantial fluid communication with at least one passage 64 through the cylinder 12. The passage 64 is in permanent fluid communication with an annular recess 66 inside the cylinder 12 adjacent the nose piston 14. The annular recess 66 in turn is in fluid communication with the venturi bore 50. O-rings 68 are positioned between the ring 58 and the cylinder 12 as fluid seals. The closed position of the ring 58 is a position in which the recess 62 is no longer in substantial fluid communication with the passage 64.

Figure 5:
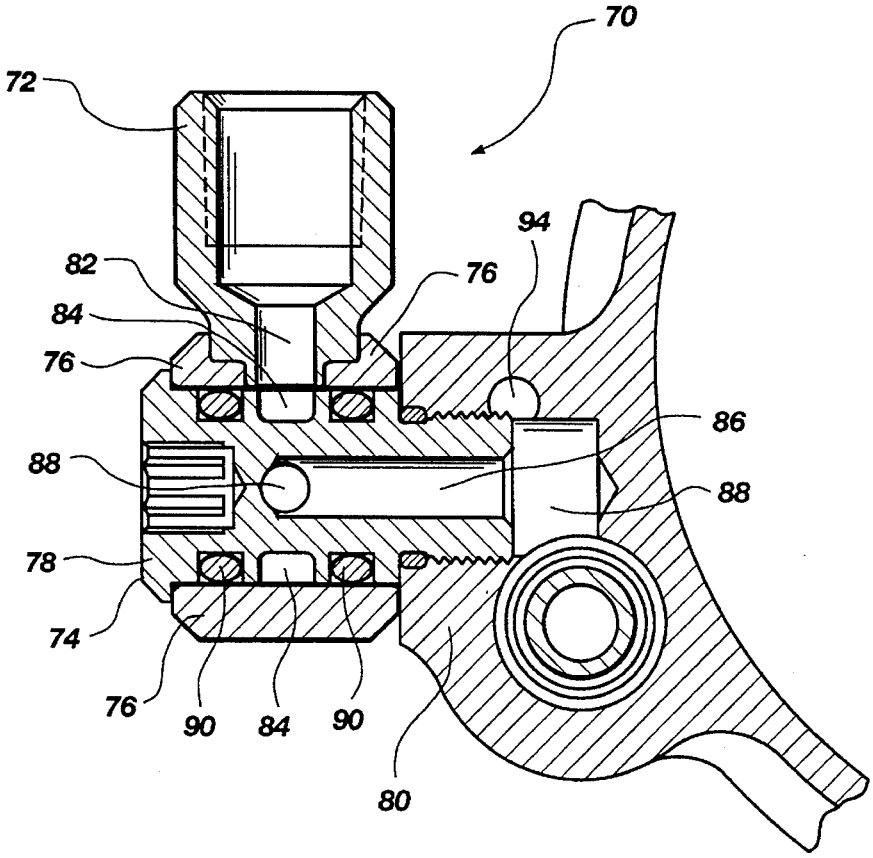
FIG. 5 is a cross-sectional view taken along line 5—5 of FIG. 4, further illustrating the air inlet swivel.

With reference to FIGS. 4 and 5, the tool 10 is connectable to a conventional pressurized air hose (not shown) at an air feed which is indicated generally at 70. The air feed 70 includes a hose connector 72 which is in fluid communication with an air inlet swivel 74. The hose connector 72 is connectable to the conventional air hose. The hose connector 72 is secured to a swivel ring 76 which is preferably rotatable through 360 degrees or more about a swivel bolt 78. Rotation of the swivel ring 76, and hence of the hose connector 72, allows a hose connected to the connector 72 to hang generally downward as the tool 10 is positioned by the user, thereby reducing the amount of hose the user must lift to position the tool 10. The swivel bolt 78 is threaded into a mount 80 which extends from the tool 10.

To allow fluid communication between the pressurized air hose and the tool 10, a passage 82 in the hose connector 72 communicates with an annular chamber 84 in the swivel bolt 78. The annular chamber 84 communicates with a second passage 86 which leads to a chamber 88. O-rings 90 are placed between the swivel bolt 78 and the swivel ring 76 as fluid seals. Thus, a pressurized gas such as pressurized air may be transported, without substantial loss, from the hose connector passage 82 through the annular chamber 84 and the passage 86 to the chamber 88 while the hose connector 72 rotates.

With reference to FIGS. 3 through 5, a flexible tube 92 provides fluid communication between the chamber 88 and the recess 62 on the inner surface of the slide valve ring 58. The tube 92 is in fluid communication at one end with an inlet 94 and at the other end with an outlet 96. The inlet 94 is in fluid communication with the chamber 88. The outlet 96, which is formed in the ring 58, is in fluid communication with the recess 62. Thus, when the ring 58 is in the open position shown in FIG. 3, pressurized air is allowed to flow from the air feed 70 to the venturi bore 50. Similarly, when the ring 58 is in a closed position, the lack of substantial fluid communication between the recess 62 and the passage 64 prevents any substantial air flow from the air feed 70 to the venturi bore 50.

With reference to FIG. 1, a pintail container 100 is secured to the nose piston cylinder 12 about the tail orifice 24 of the longitudinal bore 20. The pintail container 100 includes an inner bottle 102 and an outer bottle 104 which are rotatable relative to one another. Each of the bottles 102, 104 has an opening 108 in its side. Thus, pintails may be removed from the container by rotating the bottles 102, 104 until the openings 108 align and then dropping the pintails through the openings 108. The openings 108 are preferably slot-shaped, but those of skill in the art will appreciate that substantially circular, triangular, or square openings, as well as opening of other shapes, may be used in alternative embodiments.

To facilitate rotation, the outer bottle 104 has longitudinal protruding ribs 106 (FIG. 4) around its side. The ribs 106 are preferably spaced about 30 degrees apart around the outer bottle 104. Those of skill in the art will appreciate that differently spaced ribs, knurls, or a slip-resistant material such as rubber may also be positioned around the outer bottle 104 to enhance the user's ability to grasp the bottle 104 and rotate it by hand.

As shown in FIG. 1, the tool 10 also includes an assembly, generally indicated at 110, for pressurizing the nose piston cylinder 12. The pressurizing assembly 110 includes an air cylinder 112 in which a piston head 114 is disposed. The piston head 114 divides the air cylinder 112 into a variably-sized drive chamber 116 and a corresponding variably-sized release chamber 118. The size of one of the chambers 116, 118 grows, and the size of the other of the chambers 116, 118 shrinks, as the piston head 114 slides within the air cylinder 112.

A hydraulic cylinder 120 defines a hydraulic chamber 122 containing an incompressible hydraulic fluid. The hydraulic chamber 122 is positioned adjacent the air cylinder 112. The hydraulic chamber 122 is separated from the drive chamber 118 by a conventional gland assembly 124. A piston rod 126 which is rigidly secured to the piston head 114 slides within the hydraulic chamber 122 as the piston head 114 slides within the air cylinder 112.

The hydraulic chamber 122 is in fluid communication with a nose piston cylinder hydraulic chamber 128 inside the nose piston cylinder 12. A dampening valve 130 allows gradual movement of hydraulic fluid from the hydraulic chamber 122 to the nose piston cylinder chamber 128 while inhibiting rapid fluid movement in the opposite direction.

The exterior of the hydraulic cylinder 120 serves as a hand grip 140 or handle for the user. The hydraulic cylinder 120 is oriented at an angle $\Theta$ in the range from about 10 degrees to about 20 degrees away from a right angle with respect to the longitudinal axis of the nose piston cylinder 12. The angle $\Theta$ thus lies within the range of positions taken naturally by a user's hand with respect to their forearm. The centerline of a typical user's grip is typically several degrees away from a right angle. That is, if a user grips a straight rod in a natural way and with no forces acting on the rod other than the user's grip and gravity, the rod will typically be held at an angle from about 10° to about 20 degrees away from a right angle with respect to the user's forearm. Thus, the nose piston cylinder 12 and the user's forearm (not shown) can each be held perpendicular to the workpieces (not shown) without forcing the user's wrist into an uncomfortable position.

Figure 6:
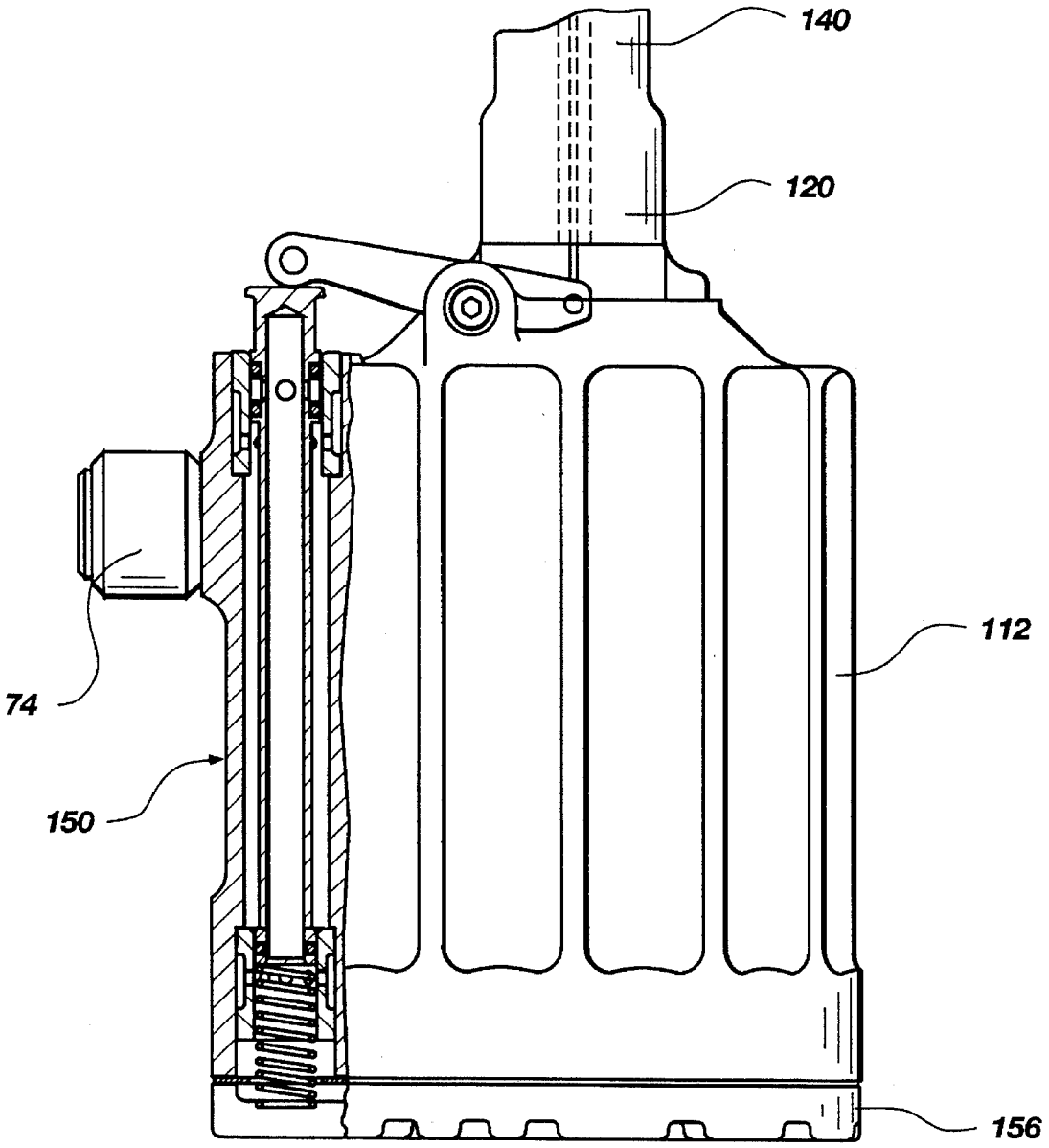
FIG. 6 is a partial cross-sectional view illustrating a stable base of the installation tool, as well as a portion of a throttle of the tool.

With reference to FIGS. 1 and 6, the air cylinder 112 is in fluid communication with a throttle, which is generally indicated at 150. The throttle 150 is connectable to a conventional pressurized air hose (not shown) by way of the air inlet swivel 74. The throttle 150 includes a trigger 152 for selective pressurization of the drive chamber 116 of the air cylinder 112.

The air cylinder 112 is also in fluid communication with an exhaust path which leads from the drive chamber 116 to the ambient environment outside the tool. A muffler 154 disposed along the exhaust path muffles the flow of air exhausted from the drive chamber 116, making the tool 10 quieter during use than unmuffled conventional tools. The muffler 154 preferably comprises a wire mesh, but other embodiments include plastic formed in a mesh or a web.

The weight of the nose piston 14 and the other components of the tool 10 is distributed such that the air cylinder 112 forms a stable base 156 for the tool 10. The base 156 has sufficient area, and is positioned relative to the tool's mass, to be capable of stable engagement with a resting surface such as a table or floor (not shown). That is, the tool 10 may be placed in a stable position on the resting surface with the nose piston cylinder 12 spaced substantially above the resting surface. In such a position, the tool's handle 140 is easily grasped by the user. Moreover, the risk of contaminating the nose assembly 30 (FIG. 2) is greatly reduced because the nose assembly 30 is held above the work area floor by the air cylinder 112, the handle 140, and the nose piston cylinder 12.

In operation, with reference to FIGS. 1 and 2, the pintail of a pintail fastener (not shown) is placed between the jaws 32 of the nose assembly 30 and a portion of the fastener is placed within aligned holes in two or more workpieces (not shown). The trigger 152 of the throttle 150 is activated by pressure of the user's finger, thereby allowing pressurized air to flow from an attached conventional air hose (not shown) through the air inlet swivel 74 (FIG. 5) into the drive chamber 116. Pressurization of the drive chamber 116 increases the size of the chamber 116 by driving the piston head 114 into the release chamber 118. The piston head 114 in turn drives the piston rod 126 toward the nose piston cylinder 12. In so moving, the piston rod 126 pressurizes the hydraulic fluid within the hydraulic chamber 122, and hence pressurizes the hydraulic fluid within the nose piston cylinder chamber 128.

The increased pressure in the nose piston cylinder 12 urges the nose piston 14 away from its initial "ready" position and thus away from the workpieces (not shown). The nose piston 14 in turn creates an installation force which is transferred to the attached nose assembly 30. The installation force tightens the nose assembly jaws 32 about the pintail and pulls the pintail away from the workpieces in the direction indicated by Arrow A. In response, the fastener's head deforms, and the fastener's pintail eventually detaches from the rest of the fastener. At this point the nose piston 14 is in its "detaching" position, which may vary slightly from one fastener to the next.

Upon detachment, the tool 10 is typically removed from the workpieces. Thus, the nose piston 14 may move toward the nose assembly 30, in the direction opposite to that indicated by Arrow A. Movement of the piston 14 is dampened by the hydraulic fluid in the chambers 122, 128 because sudden flow of the hydraulic fluid back into the hydraulic chamber 122 is restricted by the dampening valve 130. The hydraulic fluid flowing from the nose piston cylinder hydraulic chamber 128 back into the handle's hydraulic cylinder 122 urges the piston rod 126 away from the nose piston cylinder 12, and hence moves the piston head 114 in a direction that decreases the size of the drive chamber 116. The throttle 150 is configured to open the exhaust path when the nose piston 14 reaches the detachment position, so the air from the drive chamber 116 flows out through the muffler 154 toward the ambient environment.

If the slide valve 56 is in the open position (shown in FIG. 3), the detached pintail will not remain in the longitudinal piston bore 20, but will rather be forced by the venturi effect into contact with a deflector (not shown) or the pintail container 100. When the slide valve 56 is open and the nose piston 14 has returned to its initial position nearest the nose assembly 30, air flows through the venturi bore 50 (FIG. 3) under pressure. Air flowing through the venturi bore 50 into the longitudinal bore 20 creates the venturi effect.

With reference to FIG. 3, the venturi bore 50 is preferably positioned relative to the nose piston cylinder 12 such that the nose piston cylinder 12 blocks air flow to the venturi bore 50 as the nose piston 14 approaches the detaching position during installation, even if the slide valve 56 is open. Thus, the entire pressurized air flow from the air compressor is applied to the drive chamber 116 (FIG. 1) during installation. The venturi effect is created only when the nose piston 14 is near its ready position and the slide valve 56 is open.

However, control of the venturi effect is not limited to this automatic control which is based on the nose piston's position. In addition, users may easily slide the ring 58 to close the slide valve 56, thereby conserving compressed air when the tool 10 is not in active use or when the tool 10 is in use but no venturi is needed to remove pintails from the nose assembly 30 (FIG. 2) and the nose piston 14.

Thus, the pintail fastener installation tool of the present invention provides an easily-operated and flexible collector which utilizes a venturi effect to remove a pintail from the nose assembly and nose piston after the pintail is detached from a fastener. The slide valve is easily opened or closed with a single movement of the user's hand, rather than requiring multiple rotations and/or additional tools, as in conventional installation tools. The control is flexible in that the slide valve allows a user to override the automatic position-based venturi shut-off in order to further conserve compressed air.

In addition, the tool of the present invention collects the detached pintails in an easily-emptied container rather than allowing them to hit the user or the work area floor. The ribbed outer bottle is easily rotated to align the bottle slots and allow the spent pintails to fall out into a disposal area.

Moreover, the tool facilitates proper positioning by reducing the stresses imposed on a user in several ways. The air inlet swivel allows the hose to hang generally straight downward. The handle is angled relative to the nose piston cylinder to ease stresses on the user's wrist. The exhaust path is muffled to ease noise which deters the user from approaching the tool sufficiently to position it correctly. The tool base also makes the tool easier to pick up, and reduces the risk of nose assembly contamination by positioning the nose assembly above the work area floor when the tool is set down.

The invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated by the appended claims rather than by the foregoing description. All changes which come within the meaning and range of equivalency of the claims are to be embraced within their scope.

What is claimed and desired to be secured by patent is:

1. A tool for use in installing fasteners in workpieces, each fastener including a deformable head and a detachable pintail, each fastener capable of being installed by application to the fastener of an installation force which deforms the head and detaches the pintail, said tool being connectable to a nose assembly which is configured to apply an installation force, said tool comprising:

a nose piston cylinder;

a nose piston slidably disposed within said nose piston cylinder, said nose piston having a nose end and a tail end, said nose end of said nose piston being connectable to the nose assembly, said nose piston having a longitudinal bore connecting a nose orifice in said nose end with a tail orifice in said tail end, said nose piston also having a venturi bore which meets said longitudinal bore at a venturi orifice, such that air flowing through said venturi orifice under sufficient pressure creates a venturi effect capable of drawing a detached pintail to and through said tail orifice, said venturi bore being connectable at an air feed to a source of pressurized air;

a slide valve disposed about the exterior of said nose piston cylinder between said venturi bore and said air feed, said slide valve being linearly slidable between an open position, which allows pressurized air to flow from said air feed to said venturi bore, and a closed position, which prevents air flow from said air feed to said venturi bore; and means for pressurizing said nose piston cylinder.

2. The tool of claim 1, wherein said slide valve comprises a ring disposed about the exterior of said nose piston cylinder.

3. The tool of claim 1, wherein said slide valve comprises an outer surface having projections to facilitate sliding movement of said slide valve by a user's hand.

4. The tool of claim 1, wherein said slide valve includes a recess which is in substantial fluid communication with said air feed, said recess is positioned on an inner surface of said slide valve adjacent said nose piston cylinder, said recess is in substantial fluid communication with said venturi bore when said slide valve is in said open position, and said recess is not in substantial fluid communication with said venturi bore when said slide valve is in said closed position.

5. The tool of claim 1, wherein said means for pressurizing said nose piston cylinder comprises:

an air cylinder;

a piston head slidably disposed within said air cylinder which divides said air cylinder into a variably-sized drive chamber and a corresponding variably-sized release chamber;

a hydraulic cylinder positioned adjacent said air cylinder and separated from said air cylinder by a gland assembly; and a piston rod secured to said piston head and slidably disposed within said hydraulic cylinder;

wherein said hydraulic cylinder is in fluid communication with said nose piston cylinder such that pressurization of said drive chamber drives said piston rod until said piston rod pressurizes a hydraulic fluid within said hydraulic cylinder and hence within said nose piston cylinder to thereby urge said nose piston away from the workpieces and hence apply an installation force to the fastener through the nose assembly.

6. The tool of claim 5, further comprising a dampening valve disposed between said hydraulic cylinder and said nose piston cylinder for dampening sudden flow of said hydraulic fluid in response to detachment of a pintail.

7. The tool of claim 5, further comprising a throttle which is connectable to a source of pressurized air and which is capable of selective activation to pressurize said drive chamber of said air cylinder.

8. The tool of claim 7, wherein said throttle comprises an air inlet swivel which is capable of rotating through 360 degrees while transporting pressurized air toward said drive chamber.

9. The tool of claim 5, further comprising a muffler disposed along a exhaust path between said drive chamber and the ambient environment outside said tool, said muffler being configured to muffle a flow of air exhausted from said drive chamber after application of an installation force to a fastener.

10. The tool of claim 5, wherein said air cylinder forms a base which is capable of stable engagement with a resting surface such that said tool may be placed in a stable position on the resting surface with said nose piston cylinder spaced substantially apart from the resting surface.

11. The tool of claim 1, further comprising a pintail deflector secured to said nose piston cylinder about said tail orifice of said longitudinal bore for deflecting detached pintails such that they travel at an angle to said longitudinal bore.

12. The tool of claim 1, further comprising a pintail container secured to said nose piston cylinder about said tail orifice of said longitudinal bore for containing detached pintails.

13. The tool of 12, wherein said pintail container comprises an inner bottle and an outer bottle which are rotatable relative to one another, each of said bottles having a slot, said outer bottle having a plurality of longitudinal protruding spaced-apart ribs, said bottles configured such that a pintail may be removed from within said container by rotating said bottles until said slots align and then aligning the pintail with said slots.

14. The tool of claim 1, wherein said venturi bore is oriented at an acute angle with respect to the portion of said longitudinal bore between said nose orifice and said venturi orifice.

15. A tool for use in installing fasteners in workpieces, each fastener including a deformable head and a detachable pintail, each fastener capable of being installed by application to the fastener of an installation force which deforms the head and detaches the pintail, said tool being connectable to a nose assembly which is configured to apply an installation force, said tool comprising:

a nose piston cylinder;

a nose piston slidably disposed within said nose piston cylinder, said nose piston having a nose end and a tail end, said nose end of said nose piston being connectable to the nose assembly, said nose piston having a longitudinal bore connecting a nose orifice in said nose end with a tail orifice in said tail end, said nose piston also having a venturi bore which meets said longitudinal bore at a venturi orifice, said venturi bore being oriented at an acute angle with respect to the portion of said longitudinal bore between said nose orifice and said venturi orifice such that air flowing through said venturi orifice under sufficient pressure creates a venturi effect capable of drawing a detached pintail to and through said tail orifice, said venturi bore being connectable at an air feed to a source of pressurized air;

a slide valve disposed between said venturi bore and said air feed, said slide valve being linearly slidable between an open position, which allows pressurized air to flow from said air feed to said venturi bore, and a closed position, which prevents air flow from said air feed to said venturi bore, said slide valve comprising a ring disposed about the exterior of said nose piston cylinder, said ring having a recess which is in substantial fluid communication with said air feed, said recess being positioned on the inner surface of said slide valve adjacent said nose piston cylinder, said recess being in substantial fluid communication with said venturi bore when said slide valve is in said open position, and said recess not being in substantial fluid communication with said venturi bore when said slide valve is in said closed position, said ring having an outer surface with projections to facilitate sliding movement of said slide valve by a user's hand; and means for pressurizing said nose piston cylinder.

16. The tool of claim 15, wherein said means for pressurizing said nose piston cylinder comprises:

an air cylinder;

a piston head slidably disposed within said air cylinder which divides said air cylinder into a variably-sized drive chamber and a corresponding variably-sized release chamber;

a hydraulic cylinder positioned adjacent said air cylinder and separated from said air cylinder by a gland assembly; and a piston rod secured to said piston head and slidably disposed within said hydraulic cylinder;

wherein said hydraulic cylinder is in fluid communication with said nose piston cylinder such that pressurization of said drive chamber drives said piston rod until said piston rod pressurizes a hydraulic fluid within said hydraulic cylinder and hence within said nose piston cylinder to thereby urge said nose piston away from the workpieces and hence apply an installation force to the fastener through the nose assembly.

17. The tool of claim 16, further comprising a dampening valve disposed between said hydraulic cylinder and said nose piston cylinder for dampening sudden flow of said hydraulic fluid in response to detachment of a pintail.

18. The tool of claim 16, further comprising a throttle which is connectable to a source of pressurized air and which is capable of selective activation to pressurize said drive chamber of said air cylinder, said throttle comprising an air inlet swivel which is capable of rotating through 360 degrees while transporting pressurized air toward said drive chamber.

19. The tool of claim 16, further comprising a muffler disposed along a exhaust path between said drive chamber and the ambient environment outside said tool, said muffler being configured to muffle a flow of air exhausted from said drive chamber after application of an installation force to a fastener.

20. The tool of claim 16, wherein said air cylinder forms a base which is capable of stable engagement with a resting surface such that said tool may be placed in a stable position on the resting surface with said nose piston cylinder spaced substantially apart from the resting surface.

21. The tool of claim 15, further comprising a pintail container secured to said nose piston cylinder about said tail orifice of said longitudinal bore for containing detached pintails, said pintail container comprising an inner bottle and an outer bottle which are rotatable relative to one another, each of said bottles having a slot, said outer bottle having a plurality of longitudinal protruding spaced-apart ribs, said bottles configured such that a pintail may be removed from within said container by rotating said bottles until said slots align and then aligning the pintail with said slots.

22. A tool for use in installing fasteners in workpieces, each fastener including a deformable head and a detachable pintail, each fastener capable of being installed by application to the fastener of an installation force which deforms the head and detaches the pintail, said tool being connectable to a nose assembly which is configured to apply an installation force, said tool comprising:

a nose piston cylinder;

a nose piston slidably disposed within said nose piston cylinder, said nose piston having a nose end and a tail end, said nose end of said nose piston being connectable to the nose assembly, said nose piston having a longitudinal bore connecting a nose orifice in said nose end with a tail orifice in said tail end, said nose piston also having a venturi bore which meets said longitudinal bore at a venturi orifice such that air flowing through said venturi orifice under sufficient pressure creates a venturi effect capable of drawing a detached pintail to and through said tail orifice, said venturi bore being connectable at an air feed to a source of pressurized air;

a slide valve disposed between said venturi bore and said air feed, said slide valve being linearly slidable between an open position, which allows pressurized air to flow from said air feed to said venturi bore, and a closed position, which prevents air flow from said air feed to said venturi bore, said slide valve comprising an outer surface having projections to facilitate sliding movement of said slide valve by a user's hand; and means for pressurizing said nose piston cylinder.

23. The tool of claim 22, wherein said slide valve comprises a ring disposed about the exterior of said nose piston cylinder.

24. The tool of claim 22, wherein said slide valve includes a recess which is in substantial fluid communication with said air feed, said recess is positioned on an inner surface of said slide valve adjacent said nose piston cylinder, said recess is in substantial fluid communication with said venturi bore when said slide valve is in said open position, and said recess is not in substantial fluid communication with said venturi bore when said slide valve is in said closed position.

25. The tool of claim 22, wherein said venturi bore is oriented at an acute angle with respect to the portion of said longitudinal bore between said nose orifice and said venturi orifice.

26. A tool for use in installing fasteners in workpieces, each fastener including a deformable head and a detachable pintail, each fastener capable of being installed by application to the fastener of an installation force which deforms the head and detaches the pintail, said tool being connectable to a nose assembly which is configured to apply an installation force, said tool comprising:

a nose piston cylinder;

a nose piston slidably disposed within said nose piston cylinder, said nose piston having a nose end and a tail end, said nose end of said nose piston being connectable to the nose assembly, said nose piston having a longitudinal bore connecting a nose orifice in said nose end with a tail orifice in said tail end, said nose piston also having a venturi bore which meets said longitudinal bore at a venturi orifice such that air flowing through said venturi orifice under sufficient pressure creates a venturi effect capable of drawing a detached pintail to and through said tail orifice, said venturi bore being connectable at an air feed to a source of pressurized air;

a slide valve disposed between said venturi bore and said air feed, said slide valve being linearly slidable between an open position, which allows pressurized air to flow from said air feed to said venturi bore, and a closed position, which prevents air flow from said air feed to said venturi bore, said slide valve including a recess which is in substantial fluid communication with said air feed, said recess being positioned on an inner surface of said slide valve adjacent said nose piston cylinder, said recess being in substantial fluid communication with said venturi bore when said slide valve is in said open position, and said recess not being in substantial fluid communication with said venturi bore when said slide valve is in said closed position; and means for pressurizing said nose piston cylinder.

27. The tool of claim 26, wherein said slide valve comprises a ring disposed about the exterior of said nose piston cylinder.

28. The tool of claim 26, wherein said slide valve comprises an outer surface having projections to facilitate sliding movement of said slide valve by a user's hand.

29. The tool of claim 26, wherein said venturi bore is oriented at an acute angle with respect to the portion of said longitudinal bore between said nose orifice and said venturi orifice.

* * * * *